US011328678B2

(12) United States Patent
Chen et al.

(10) Patent No.: US 11,328,678 B2
(45) **Date of Patent: *May 10, 2022**

(54) DISPLAY PANEL, PIXEL DRIVING CIRCUIT, AND DRVING METHOD THEREOF

(71) Applicant: Shenzhen China Star Optoelectronics Semiconductor Display Technology Co., Ltd., Guangdong (CN)

(72) Inventors: Xiaolong Chen, Shenzhen (CN); Yi-Chien Wen, Shenzhen (CN); Ming-Jong Jou, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/033,895

(22) Filed: Sep. 27, 2020

(65) Prior Publication Data

US 2021/0012719 A1 Jan. 14, 2021

Related U.S. Application Data

(63) Continuation of application No. 16/675,261, filed on Nov. 6, 2019, now Pat. No. 10,825,399, which is a (Continued)

(30) Foreign Application Priority Data

Apr. 28, 2017 (CN) ..... 201710299022.6

(51) Int. Cl.
*G09G 3/3291* (2016.01)
*G09G 3/3233* (2016.01)
*G09G 3/3225* (2016.01)

(52) U.S. Cl.
CPC ... *G09G 3/3291* (2013.01); *G09G 2320/0233* (2013.01); *G09G 2320/045* (2013.01)

(58) Field of Classification Search
CPC ..... G09G 3/3233; G09G 2320/043; G09G 2320/045
See application file for complete search history.

(56) References Cited

U.S. PATENT DOCUMENTS 9,384,694 B2 * 7/2016 Guo ..... G09G 3/3233
2002/0043991 A1 * 4/2002 Nishitoba ..... G09G 3/3233 327/94

(Continued)

FOREIGN PATENT DOCUMENTS

CN 1577453 A 2/2005
CN 1744774 A 3/2006

(Continued)

*Primary Examiner* — Sepehr Azari
(74) *Attorney, Agent, or Firm* — PV IP PC; Wei Te Chung; Ude Lu

(57) ABSTRACT

A pixel driving circuit includes a driving transistor, a first switch, a second switch, a third switch, a fourth switch, a first capacitor, a second capacitor, an initial-voltage-signal terminal, a data-voltage-signal terminal, and a driving-voltage-signal terminal. The driving transistor includes a gate terminal, a source terminal, and a drain terminal. The first switch is disposed between the gate terminal and the drain terminal. The gate terminal is connected with the initial-voltage-signal terminal via the second switch. The source terminal is connected with the driving-voltage-signal terminal and the data-voltage-signal terminal via the third switch and the fourth switch, respectively. The first capacitor is connected between the gate terminal and a ground terminal. The second capacitor is connected between the gate terminal and the source terminal. A pixel driving method and a display panel are also provided.

8 Claims, 8 Drawing Sheets

Related U.S. Application Data continuation of application No. 15/744,079, filed on Jan. 12, 2018, now Pat. No. 10,522,079.

(56) References Cited

U.S. PATENT DOCUMENTS

| | | | | |
|---|---|---|---|---|
| 2009/0027312 | A1 | 1/2009 | Han et al. | |
| 2009/0295691 | A1 | 12/2009 | Handa et al. | |
| 2010/0109985 | A1 | 5/2010 | Ono | |
| 2014/0111490 | A1 | 4/2014 | Lee et al. | |
| 2015/0317931 | A1* | 11/2015 | Tseng | G09G 3/3233 345/78 |
| 2016/0055797 | A1* | 2/2016 | Tan | G09G 3/3225 345/206 |
| 2016/0063922 | A1 | 3/2016 | Tsai et al. | |

FOREIGN PATENT DOCUMENTS

| | | | |
|---|---|---|---|
| CN | 1909045 | A | 2/2007 |
| CN | 102467876 | A | 5/2012 |
| CN | 102842283 | A | 12/2012 |
| CN | 103050080 | A | 4/2013 |
| CN | 103137062 | A | 6/2013 |
| CN | 103150991 | A | 6/2013 |
| CN | 104409042 | A | 3/2015 |
| CN | 104658483 | A | 5/2015 |
| CN | 106960659 | A | 7/2017 |
| JP | 2011069943 | A | 4/2011 |
| JP | 2016095366 | A | 5/2016 |

* cited by examiner

DISPLAY PANEL, PIXEL DRIVING CIRCUIT, AND DRVING METHOD THEREOF

CROSS REFERENCE TO RELATED APPLICATIONS

This is a continuation application of co-pending U.S. patent application Ser. No. 16/675,261, filed on Nov. 6, 2019, which is a continuation application of U.S. patent applicant Ser. No. 15/744,079, filed on Jan. 12, 2018, which is a national stage of PCT Application No. PCT/CN2017/113909 filed on Nov. 30, 2017, claiming foreign priority of Chinese Patent Application No. 201710299022.6 filed on Apr. 28, 2017, entitled "Display Panel, Pixel Driving Circuit, and Driving Method Thererof", the disclosure of which is hereby incorporated by reference in its entirety.

BACKGROUND OF THE APPLICATION

1. Field of the Invention

The present application relates to a field of display technology, and more particularly to a pixel driving circuit, a driving method thereof, and a display panel comprises the pixel driving circuit.

2. Description of Prior Art

Due to the instability and technical limitations of the organic light-emitting diode (OLED) display panel manufacturing process, the threshold voltage of the driving transistor of each pixel unit in the OLED display panel may be different, which may result in inconsistence in the current in the LED of each pixel unit, thereby causing the uneven brightness of the OLED display panel.

In addition, as the driving time of the driving transistor goes by, the material of the driving transistor will be aged or mutated, causing the threshold voltage of the driving transistor to drift. Moreover, the degrees of aging of the material of the driving transistors are different, resulting in different threshold voltage drifts of the driving transistors in the OLED display panel, which may also cause the display unevenness of the OLED display panel, and the display unevenness may become more serious with the driving time and the aging of the drive transistor material.

SUMMARY OF THE APPLICATION

In view of the above problems, an object of the present application is to provide a pixel driving circuit, a driving method thereof and a display panel comprising the pixel driving circuit so as to improve brightness uniformity of the display panel.

In order to solve the problems in the prior art, the present application provides a pixel driving circuit, which comprises a driving transistor, a first switch, a second switch, a third switch, a fourth switch, a first capacitor, a second capacitor, an initial-voltage-signal terminal, a data-voltage-signal terminal, and a driving-voltage-signal terminal. The driving transistor comprises a gate terminal, a source terminal, and a drain terminal.

The first switch is disposed between the gate terminal and the drain terminal. The gate terminal is connected with the initial-voltage-signal terminal via the second switch. The source terminal is connected with the driving-voltage-signal terminal and the data-voltage-signal terminal via the third switch and the fourth switch, respectively.

The first capacitor is connected between the gate terminal and a ground terminal. The second capacitor is connected between the gate terminal and the source terminal.

Wherein the pixel driving circuit further comprises a first control-signal terminal. The first control-signal terminal is connected with a control terminal of the first switch, a control terminal of the third switch, and a control terminal of the fourth switch, so as to control on/off of the first switch, the third switch and the fourth switch.

Wherein the pixel driving circuit further comprises a second control-signal terminal. The second control-signal terminal is connected with a control terminal of the second switch, so as to control on/off of the second switch.

Wherein the pixel driving circuit further comprises a fifth switch, a light-emitting diode and a negative voltage-signal terminal. The light-emitting diode comprises a positive terminal and a negative terminal. The fifth switch is connected between the drain terminal and the positive terminal, so as to control on/off of the driving transistor and the light-emitting diode, the negative terminal is connected with the negative voltage-signal terminal.

Wherein the pixel driving circuit further comprises a third control-signal terminal. The third control-signal terminal is connected with a control terminal of the fifth switch, so as to control on/off of the fifth switch.

The embodiment of the present application provides a display panel, which comprises the pixel driving circuit in any of the above embodiments.

The embodiment of the present application provides a pixel driving method, which comprises:

A pixel driving circuit is provided; the pixel driving circuit comprises a driving transistor, a first capacitor and a second capacitor. The driving transistor comprises a gate terminal, a source terminal and a drain terminal. The first capacitor is connected between the gate terminal and a ground terminal. The second capacitor is connected between the gate terminal and the source terminal.

A reset phase, an initial voltage is applied to the gate terminal and a driving voltage is applied to the source terminal, so as to reset a potential of the gate terminal and a potential of the source terminal.

A storage phase, a data voltage is loaded to the source terminal and the gate terminal and the drain terminal are conducted, so that the data voltage charges the gate terminal until a potential difference between the source terminal and the gate terminal is a Vth. The Vth is a threshold voltage of the driving transistor, and the potential of the gate terminal is stored in the first capacitor and the Vth is stored in the second capacitor.

A lighting phase, the driving voltage is loaded to the source terminal, and the potential of the gate terminal is charged, so as to stabilize a driving current of the driving transistor.

Wherein the pixel driving circuit further comprises a first switch, a second switch, a third switch, a fourth switch, a fifth switch, a light-emitting diode, a first control-signal terminal, a second control-signal terminal, a third control-signal terminal, an initial-voltage-signal terminal, a data-voltage-signal terminal and a driving-voltage-signal terminal. The first switch is disposed between the gate terminal and the drain terminal. The gate terminal is connected with the initial-voltage-signal terminal via the second switch. The source terminal is respectively connected with the driving-voltage-signal terminal and the data-voltage-signal terminal via the third switch and the fourth switch. The fifth switch is connected between the drain terminal and the light emitting terminal diode. The first control-signal terminal is connected with a control terminal of the first switch, a control terminal of the third switch, and a control terminal of the fourth switch. The second control-signal terminal is connected with a control terminal of the second switch. The third control-signal terminal is connected with a control terminal of the fifth switch.

In the reset phase, the first control-signal terminal and the third control-signal terminal are loaded with a high-level signal, and the second control-signal terminal is loaded with a low-level signal, so that the second switch and the third switch are turned on, the first switch, the fourth switch and the fifth switch are turned off, the gate terminal is loaded with the initial voltage via the second switch, the source terminal are loaded with the driving voltage via the third switch.

Wherein in the storing stage, the first control-signal terminal is loaded with the low-level signal, and the second control-signal terminal and the third control-signal terminal are loaded with the high-level signal, so that the first switch and the fourth switch are turned on, the second switch, the third switch, and the fifth switch are turned off. The source terminal is loaded with the data voltage via the fourth switch. The data voltage is Vdata, the data voltage charges the gate terminal via the fourth switch, the driving transistor, and the first switch, and makes the potential of the gate terminal be Vdata−Vth.

Wherein the pixel driving circuit further comprises a negative voltage-signal terminal. The light-emitting diode comprises a positive terminal and a negative terminal. The fifth switch is connected between the drain terminal and the positive terminal. The negative terminal is connected with the negative voltage-signal terminal.

In the lighting stage, the first control-signal terminal and the second control-signal terminal are loaded with the high-level signal, and the third control-signal terminal is loaded with the low-level signal, so that the third switch and the fifth switch are turned on, the second switch, the first switch, and the fourth switch are turned off. The source terminal is loaded with the driving voltage via the third switch, so as to make the driving voltage be Vdd. The gate terminal potential is Vdata−Vth+δV, and the potential difference between the source terminal and the gate terminal is Vdd−Vdata+Vth−δV, and δV=(Vdd−Vdata)*C2/(C1+C2), C1 is a capacitance value of the first capacitor; C2 is a capacitance value of the second capacitor, so that the driving current is independent of the threshold voltage. The third switch, the driving transistor and the fifth switch are turned on, so that the driving-voltage-signal terminal and the negative voltage-signal terminal are conducted, the driving current drives the light-emitting diode to light.

The pixel driving circuit provided by the present application comprises a driving transistor. The driving transistor comprises a gate terminal, a source terminal, and a drain terminal. The first switch is disposed between the gate terminal and the drain terminal. The gate terminal is connected with the initial-voltage-signal terminal via the second switch. The source terminal is connected with the driving-voltage-signal terminal and the data-voltage-signal terminal via the third switch and the fourth switch, respectively. The first capacitor is connected between the gate terminal and a ground terminal. The second capacitor is connected between the gate terminal and the source terminal. The data voltage charges the gate terminal until a potential difference between the source terminal and the gate terminal is a Vth. The source terminal is loaded with the driving voltage via the third switch, so as to make the driving voltage be Vdd and the driving current $I=k(Vdd-Vdata-\delta V)^2$, the driving current is independent of the threshold voltage, so that the current of the light-emitting diode is stable to ensure that the evenly lighting brightness of the light-emitting diode.

The pixel driving method provided by the present application makes the driving voltage be Vdd and the driving current $I=k(Vdd-Vdata-\delta V)^2$, the driving current is independent of the threshold voltage, so that the current of the light-emitting diode is stable to ensure that the evenly lighting brightness of the light-emitting diode, by resetting the source terminal and the gate terminal in the reset phase, and the data voltage charges the gate terminal until a potential difference between the source terminal and the gate terminal is a Vth in the storage phase, and the source terminal is loaded with the driving voltage via the third switch.

The display panel provided by the present application comprises the pixel driving circuit described above, so that the driving current generated by the driving transistor is independent of the threshold voltage of the driving transistor, so as to stabilize the driving current generated by the driving transistor and eliminate the driving current issues caused by the aging of the driving transistor or the limitation of the manufacturing process, the problem of threshold voltage drift is solved, so that the current flowing through the light-emitting diode is stabilized, the light emitting brightness of the light-emitting diode is uniform, and the display effect of the screen is improved.

BRIEF DESCRIPTION OF THE DRAWINGS

In order to describe the technical solutions in the embodiments of the present application or in the conventional art more clearly, the accompanying drawings required for describing the embodiments or the conventional art are briefly introduced. Apparently, the accompanying drawings in the following description only show some embodiments of the present application. For those skilled in the art, other drawings may be obtained based on these drawings without any creative work.

DETAILED DESCRIPTION OF THE PREFERRED EMBODIMENTS

The technical solutions in the embodiments of the present application are clearly and completely described below with reference to the accompanying drawings in the embodiments of the present application.

Figure 1:
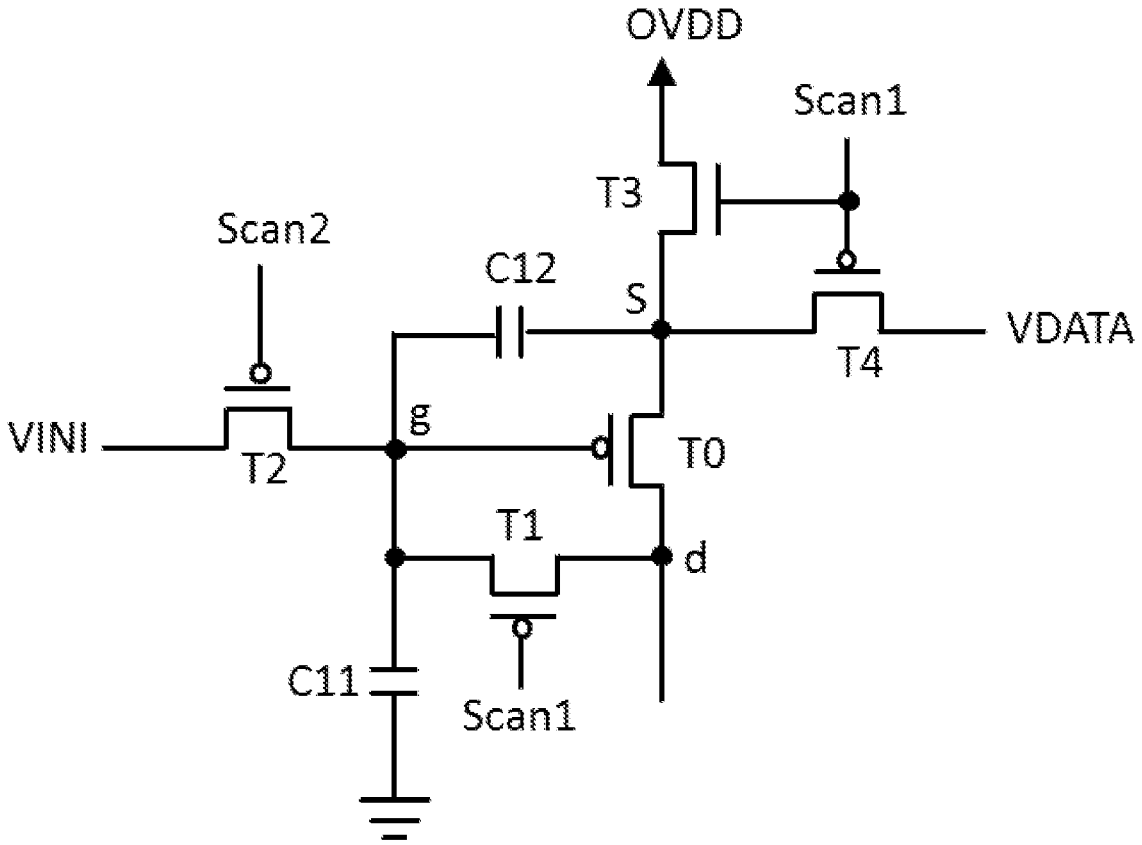
FIG. 1 is a structural illustrative diagram of a pixel driving circuit of a first embodiment according to the present application.

Please refer to FIG. 1, which is a structural illustrative diagram of a pixel driving circuit of a first embodiment according to the present application. The pixel driving circuit comprises a driving transistor T0, a first switch T1, a second switch T2, a third switch T3, a fourth switch T4, a first capacitor C11, a second capacitor C12, an initial-voltage-signal terminal VINI, a data-voltage-signal terminal VDATA, a driving-voltage-signal terminal OVDD. The driving transistor T0 comprises a gate terminal g, a source terminal s and a drain terminal d. The first switch T1 is disposed between the gate terminal g and the drain terminal d. The gate terminal g is connected with the initial-voltage-signal terminal VINI via the second switch T2 to load an initial voltage Vini at the gate terminal g. The source terminal s is respectively connected to the driving-voltage-signal terminal OVDD and the data-voltage-signal terminal VDATA via the third switch T3 and the fourth switch T4, for loading a driving voltage Vdd or a data voltage Vdata to the source terminal s. The first capacitor C11 is connected between the gate terminal g and the ground terminal, so as to store a voltage of the gate terminal g. The second capacitor C12 is connected between the gate terminal g and the source terminal s, so as to store the potential difference between the gate terminal g and the source terminal s. The switch described in this embodiment includes but is not limited to a module having a control circuit with on/off function such as a switch circuit, a thin film transistor and the like.

With a driving method, the pixel driving circuit provided in this embodiment controls the second switch T2 and the third switch T3 to be turned on, and the first switch T1 and the fourth switch T4 to be turned off, during the resetting phase, so that the gate terminal g is loaded with the initial voltage Vini and the source terminal s is loaded with the driving voltage Vdd; during the storage phase, the first switch T1 and the fourth switch T4 are turned on, the second switch T2 and the third switch T3 are turned off, so that the source terminal s is loaded with the data voltage Vdata, and the data voltage Vdata charges the gate terminal g; during the lighting phase, the third switch T3 is turned on, the second switch T2, the first switch T1, and the fourth switch T4 are turned off, the source terminal s is loaded with the driving voltage Vdd, and the potential of the gate terminal g is changed so that the driving current I generated by the driving transistor T0 is independent of the threshold voltage Vth of the driving transistor T0, so that the driving current I generated by the driving transistor T0 is stabilized.

In one embodiment, the pixel driving circuit further comprises a first control-signal terminal Scan1. The first control-signal terminal Scan1 is connected with a control terminal of the first switch T1, a control terminal of the third switch T3, and a control terminal of the fourth switch T4, so as to control on/off of the first switch T1, the third switch T3 and the fourth switch T4.

In one embodiment, the pixel driving circuit further comprises a second control-signal terminal Scan2. The second control-signal terminal Scan2 is connected with a control terminal of the second switch T2, so as to control on/off of the second switch T2.

Figure 2:
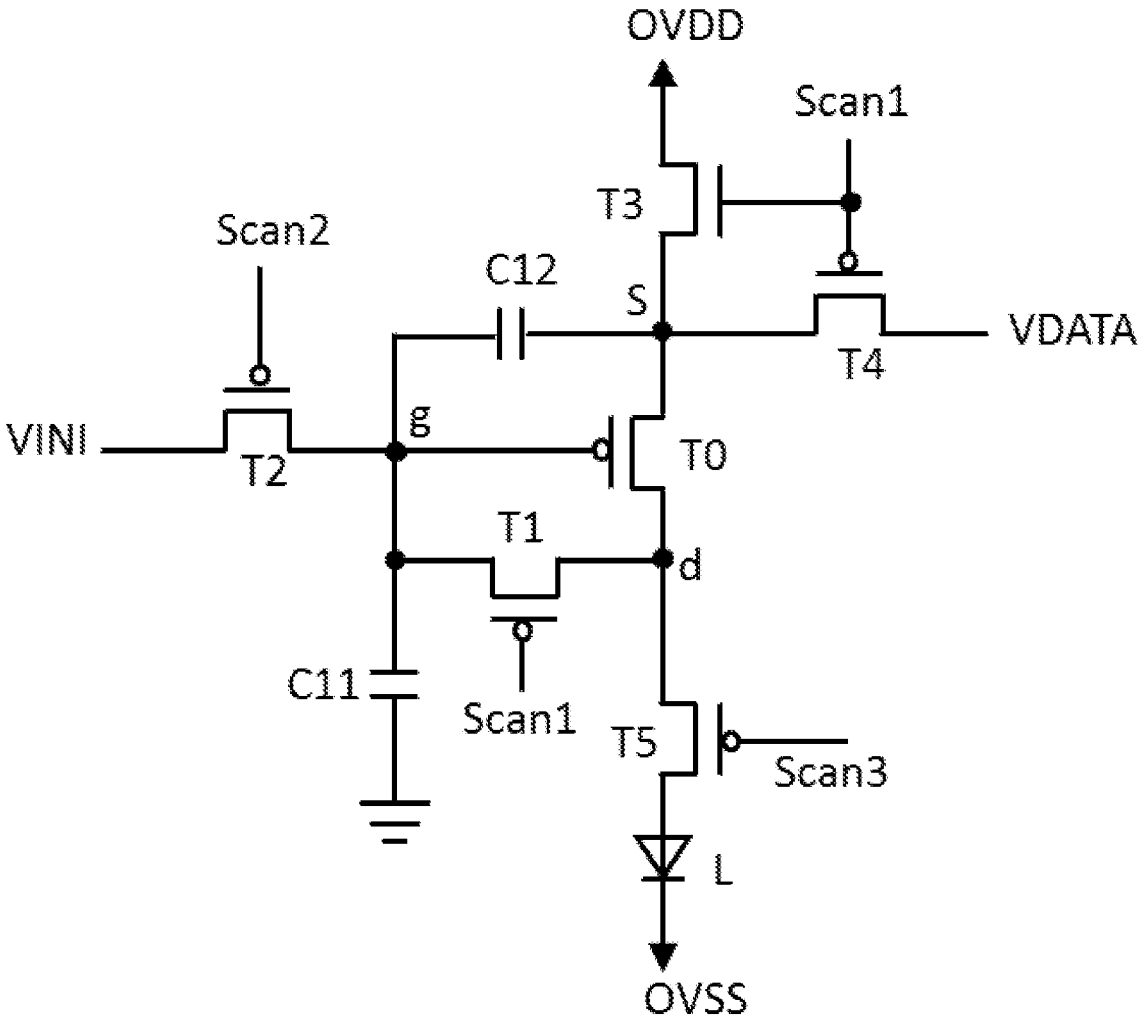
FIG. 2 is a structural illustrative diagram of a pixel driving circuit of a second embodiment according to the present application.

Please refer to FIG. 2, which is a pixel driving circuit of a second embodiment according to the present application, which comprises the pixel driving circuit provided by the first embodiment, making the driving current I generated by the driving transistor T0 stable. The embodiment further comprises a light-emitting diode L, a fifth switch T5, and a negative voltage-signal terminal OVSS. The light-emitting diode L may be an organic light-emitting diode or the like. The light-emitting diode L has a positive terminal and a negative terminal, and the fifth switch T5 is connected between the drain terminal d and the positive terminal to control on/off of the driving transistor T0 and the light-emitting diode L. The negative terminal is connected with the negative voltage-signal terminal OVSS. When the third switch T3, the driving transistor T0, and the fifth switch T5 are turned on, the driving-voltage-signal terminal OVDD and the negative voltage-signal terminal OVSS are conducted, and the driving current I generated by the driving transistor T0 drives the light-emitting diode L to light. In this embodiment, the driving current I is independent of the threshold voltage of the driving transistor T0, which eliminates the problem of threshold voltage shift caused by the aging of the driving transistor T0 or the manufacturing process of the pixel unit, so that the current flowing through the light-emitting diode L, the luminance of the light-emitting diode L is ensured to be uniform, and the display effect of the picture is improved.

In one embodiment, the pixel driving circuit further comprises a third control-signal terminal Scan3. The third control-signal terminal Scan3 is connected with a control terminal of the fifth switch T5, so as to control on/off of the fifth switch T5.

In one embodiment, the first switch T1, the driving transistor T0, the second switch T2, the fourth switch T4, and the fifth switch T5 are all P-type thin film transistors. When the control terminal of the switch is applied with a low-level voltage, the switch is in the on state, and the switch is in the off state when a high-level voltage is applied to the control terminal of the switch. The third switch T3 is an N-type thin film transistor. When a high-level voltage is applied to the control terminal of the switch, the third switch T3 is in the on state, and the control terminal of the switch applied with a low-level voltage, the third switch T3 is in the off state. In other embodiments, the first switch T1, the driving transistor T0, the second switch T2, the third switch T3, the fourth switch T4, and the fifth switch T5 may be other combination of P-type or/and N-type thin film transistor, the present application do not limit this.

In the embodiment of the present application, when the pixel driving circuit is applied to a display panel or a display device, the control-signal terminal may be connected with the scanning signal line in the display panel or the display device.

Figure 3:
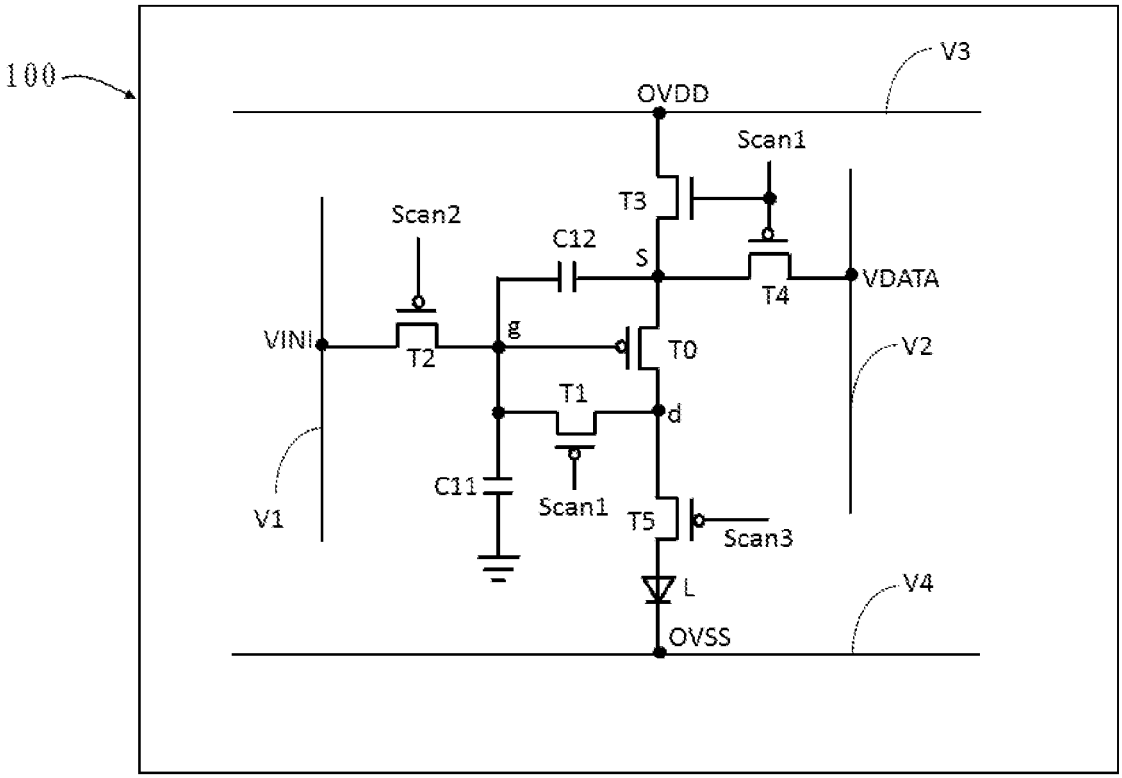
FIG. 3 is a structural illustrative diagram of a display panel of an embodiment according to the present application.

Please refer to FIG. 3, the embodiment of the present application further provides a display panel 100 comprising the pixel driving circuit provided in any one of the above embodiments and further comprises an initial-voltage-signal line V1, a data-voltage-signal line V2, a driving-voltage-signal line V3, and a negative voltage-signal line V4. The initial-voltage-signal terminal VINI is connected with the initial-voltage-signal line V1 to load the initial voltage Vini. The data-voltage-signal terminal VDATA is connected with the data-voltage-signal line V2 to load the data voltage Vdata. The driving-voltage-signal terminal OVDD is connected with the driving-voltage-signal line V3 for loading the driving voltage Vdd. The negative voltage-signal terminal OVSS is connected with the negative voltage-signal line V4 to load the negative voltage Vss. Specifically, the display panel may comprise a plurality of pixel arrays, and each pixel corresponds to any one of the pixel driving circuits in the above example embodiment. Since the pixel driving circuit eliminates the influence of the threshold voltage on the driving current I, the display of the light-emitting diode L is stable and the display brightness uniformity of the display panel is improved. Therefore, the display quality can be greatly improved.

Figure 4:
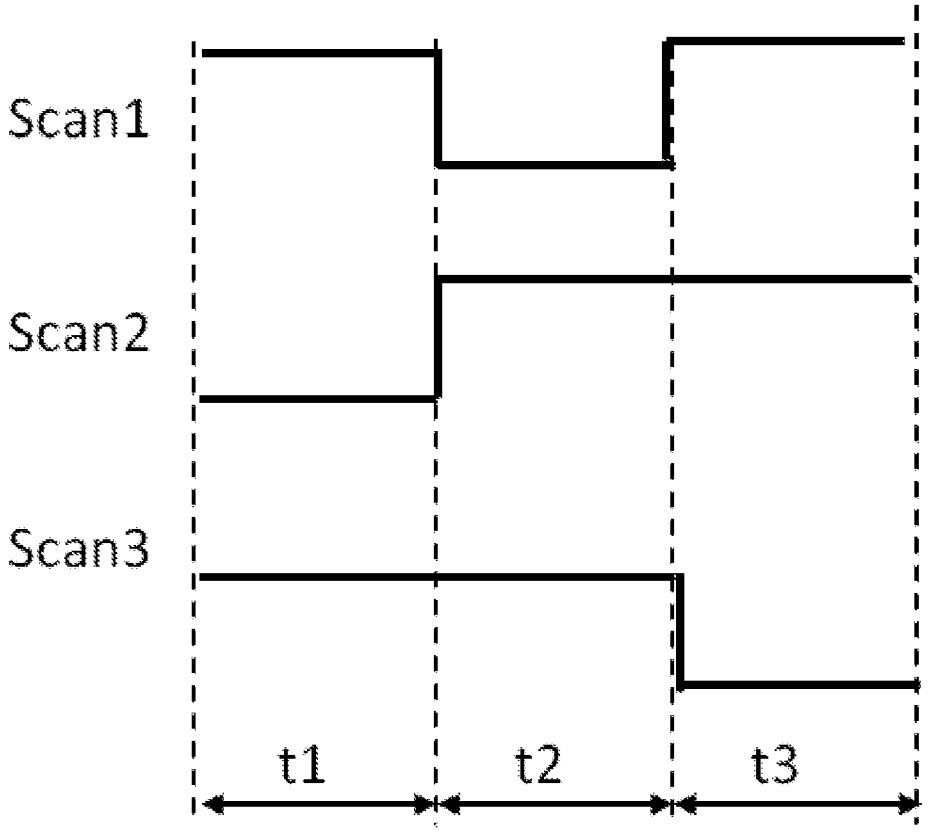
FIG. 4 is a time-domain diagram of a pixel driving circuit of an embodiment according to the present application.
Figure 5:
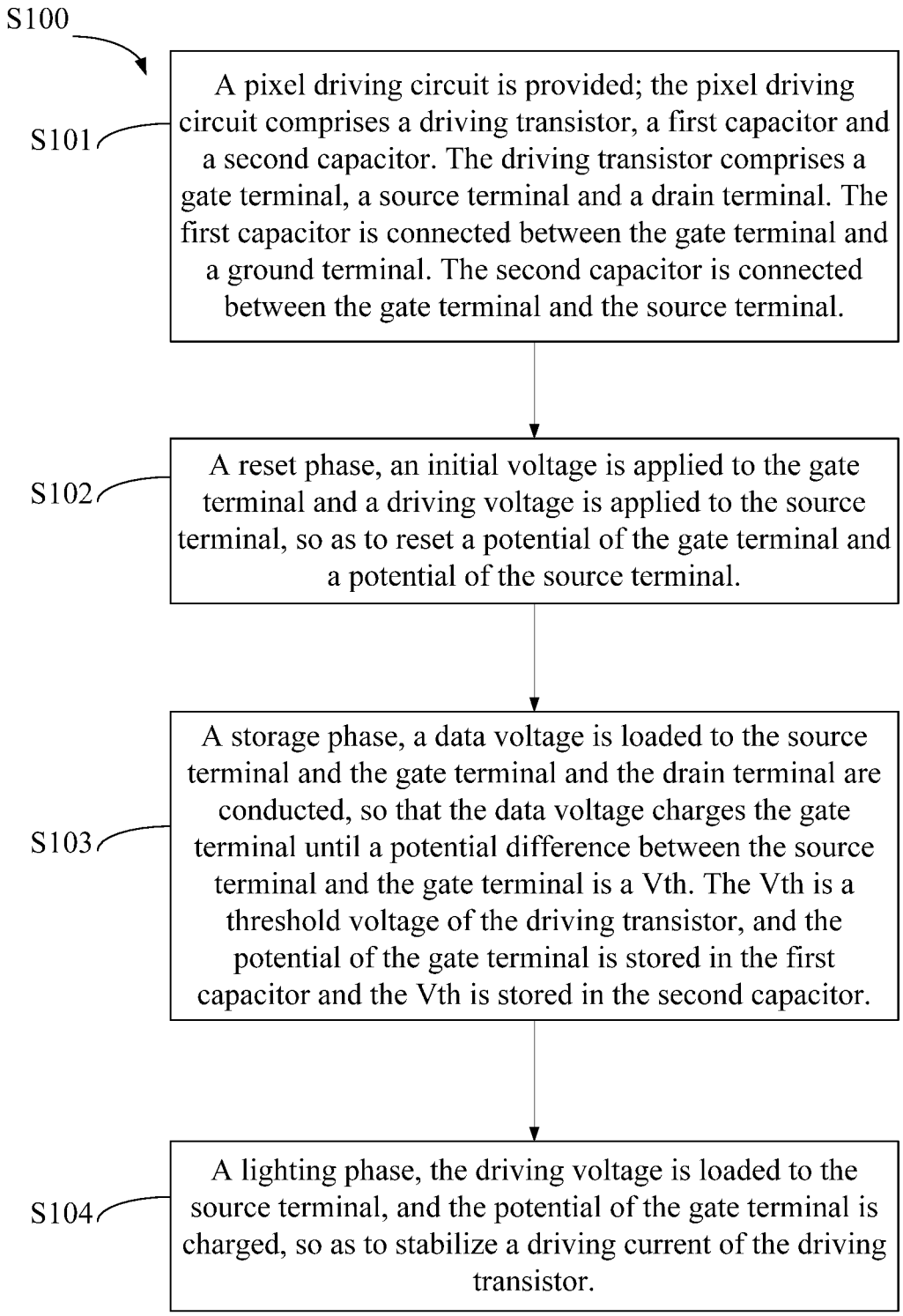
FIG. 5 is a flow diagram of a pixel driving method of one embodiment according to the present application.

Please further refer to FIGS. 4-8; FIG. 4 is a time-domain diagram of a pixel driving circuit of an embodiment according to the present application. FIG. 5 is a flow diagram of a pixel driving method S100 of one embodiment according to the present application, which is used for driving the pixel driving circuit of the above embodiment. The driving method comprises:

S101, refer to FIGS. 2-3, a pixel driving circuit is provided, which comprises a driving transistor T0, a first capacitor C11, and a second capacitor C12. The driving transistor T0 comprises a gate terminal g, a source terminal s, and a drain terminal d. The first capacitor C11 is connected between the gate terminal g and a ground terminal. The second capacitor C12 is connected between the gate terminal g and the source terminal s.

Further, the pixel driving circuit further comprises an initial-voltage-signal terminal VINI, a data-voltage-signal terminal VDATA, and a driving-voltage-signal terminal OVDD. The initial-voltage-signal terminal VINI is connected with the initial-voltage-signal line V1 for loading the initial voltage Vini. The data-voltage-signal terminal VDATA is connected with the data-voltage-signal line V2 for loading the data voltage Vdata. The driving-voltage-signal terminal OVDD is connected with the driving-voltage-signal line V3 for loading the driving voltage Vdd.

Further, the pixel driving circuit further comprises a first switch T1, a second switch T2, a third switch T3, a fourth switch T4, a fifth switch T5, a light-emitting diode L, a first control-signal terminal Scan1, a second control-signal terminal Scan2, a third control-signal terminal Scan3, an initial-voltage-signal terminal VINI, a data-voltage-signal terminal VDATA, and the driving-voltage-signal terminal OVDD. The first switch T1 is disposed between the gate terminal g and the drain terminal d, and the gate terminal g is connected with the initial voltage-signal terminal VINI via the second switch T2. The source terminal s is respectively connected to the driving-voltage-signal terminal OVDD and the data-voltage-signal terminal VDATA via the third switch T3 and the fourth switch T4. The fifth switch T5 is connected between the drain terminal d and the light-emitting diode L. The first control-signal terminal Scan1 is connected with the control terminal of the first switch T1, the control terminal of the third switch T3, and the control terminal of the fourth switch T4. The second control-signal terminal Scan2 is connected with the control terminal of the second switch T2. The third control-signal terminal Scan3 is connected with the control terminal of the fifth switch T5.

Figure 6:
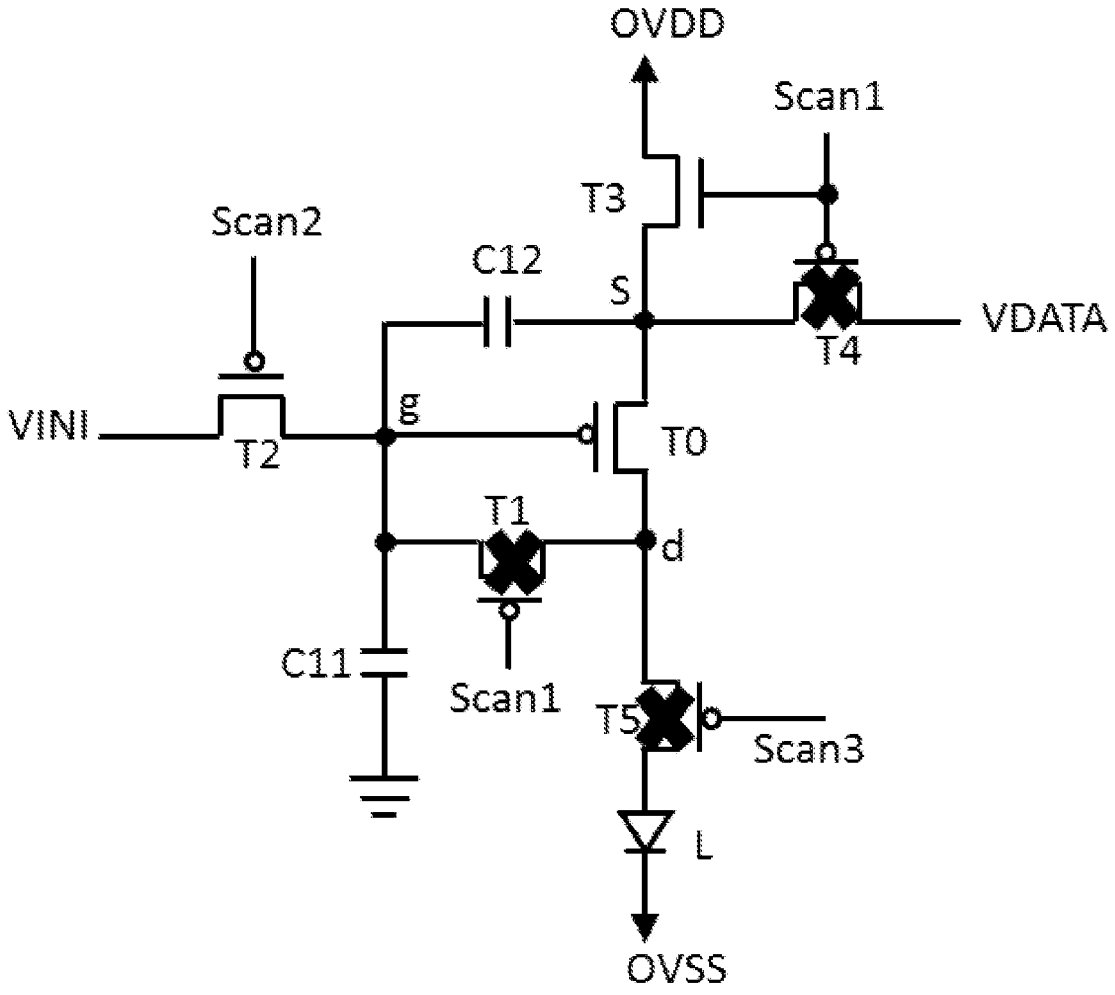
FIG. 6 is a state diagram of a reset phase of a pixel driving circuit according to an embodiment of the present application.

S102, referring to FIGS. 4-6, when entering the reset phase t1, an initial voltage Vini is applied to the gate terminal g and a driving voltage Vdd is applied to the source terminal s, such that the potential at the gate terminal g and the potential of the source terminal s are reset.

In one embodiment, the first control-signal terminal Scan1 and the third control-signal terminal Scan3 are loaded with a high-level signal, and the second control-signal terminal Scan2 is loaded with a low-level signal, so that the second switch T2 and the third switch T3 are turned on, the first switch T1, the fourth switch T4, and the fifth switch T5 are turned off. The gate terminal g is loaded with the initial voltage Vini via the second switch T2. The source terminal s is loaded with the driving voltage Vdd via the third switch T3.

Figure 7:
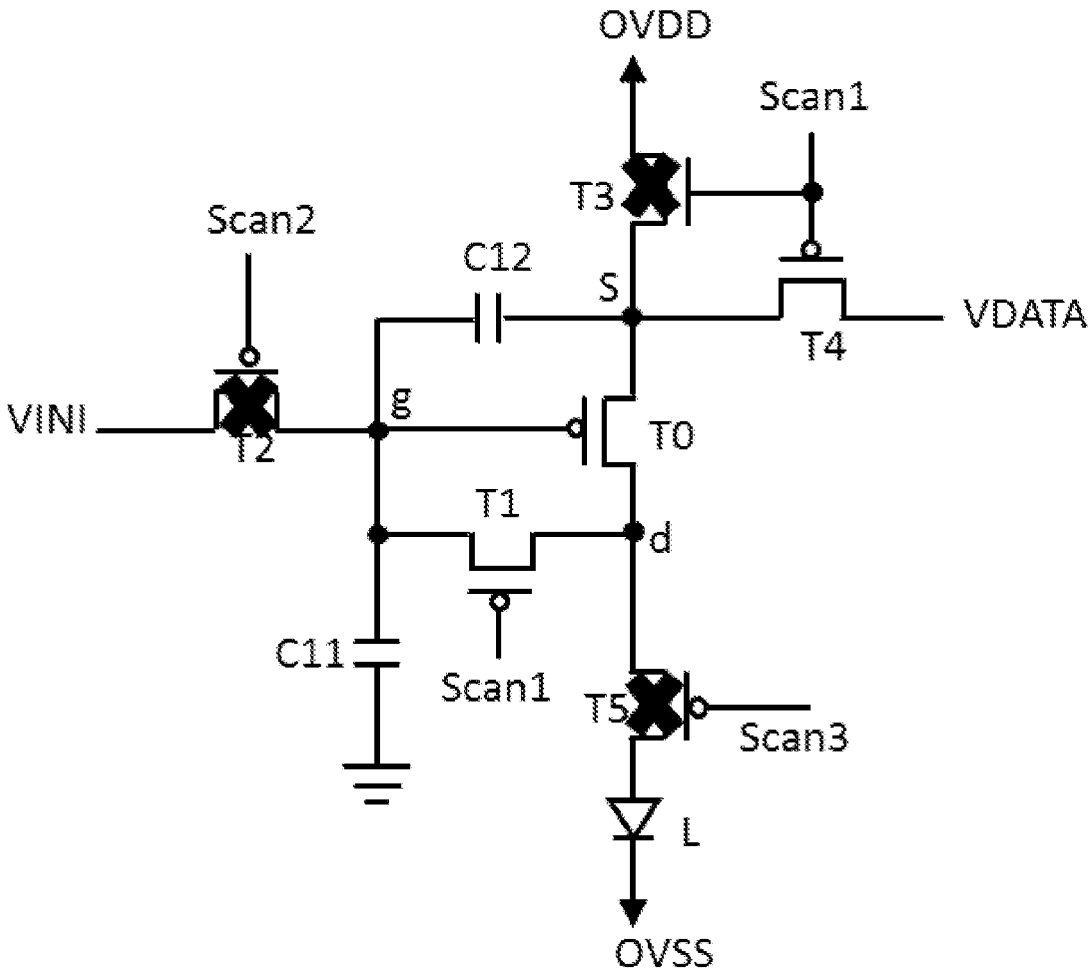
FIG. 7 is a state diagram of a storage phase of a pixel driving circuit according to an embodiment of the present application.

S103, refer to FIG. 4, FIG. 5 and FIG. 7, when entering the storage phase t2, and the source terminal is loaded with the data voltage Vdata, the gate terminal g and the drain terminal d are conducted, so that the data voltage Vdata charges the gate terminal g until the potential difference between the source terminal s and the gate terminal g is Vth, which is the threshold voltage of the driving transistor T0. The potential of the gate terminal g is stored in the first capacitor C11, and the Vth is stored in the second capacitor C12.

In one embodiment, the first control-signal terminal Scan1 is loaded a low-level signal, and the second control-signal terminal Scan2 and the third control-signal terminal Scan3 are loaded with a high-level signal, so that the switch T1 and the fourth switch T4 are turned on, the second switch T2, the third switch T3 and the fifth switch T5 are turned off. The source terminal s is loaded with the data voltage Vdata via the fourth switch T4. The data voltage Vdata charges the gate terminal g via the fourth switch T4, the driving transistor T0, and the first switch T1 until a potential difference between the source terminal s and the gate terminal g is Vth, and making the potential of the gate terminal g is Vdata−Vth.

Figure 8:
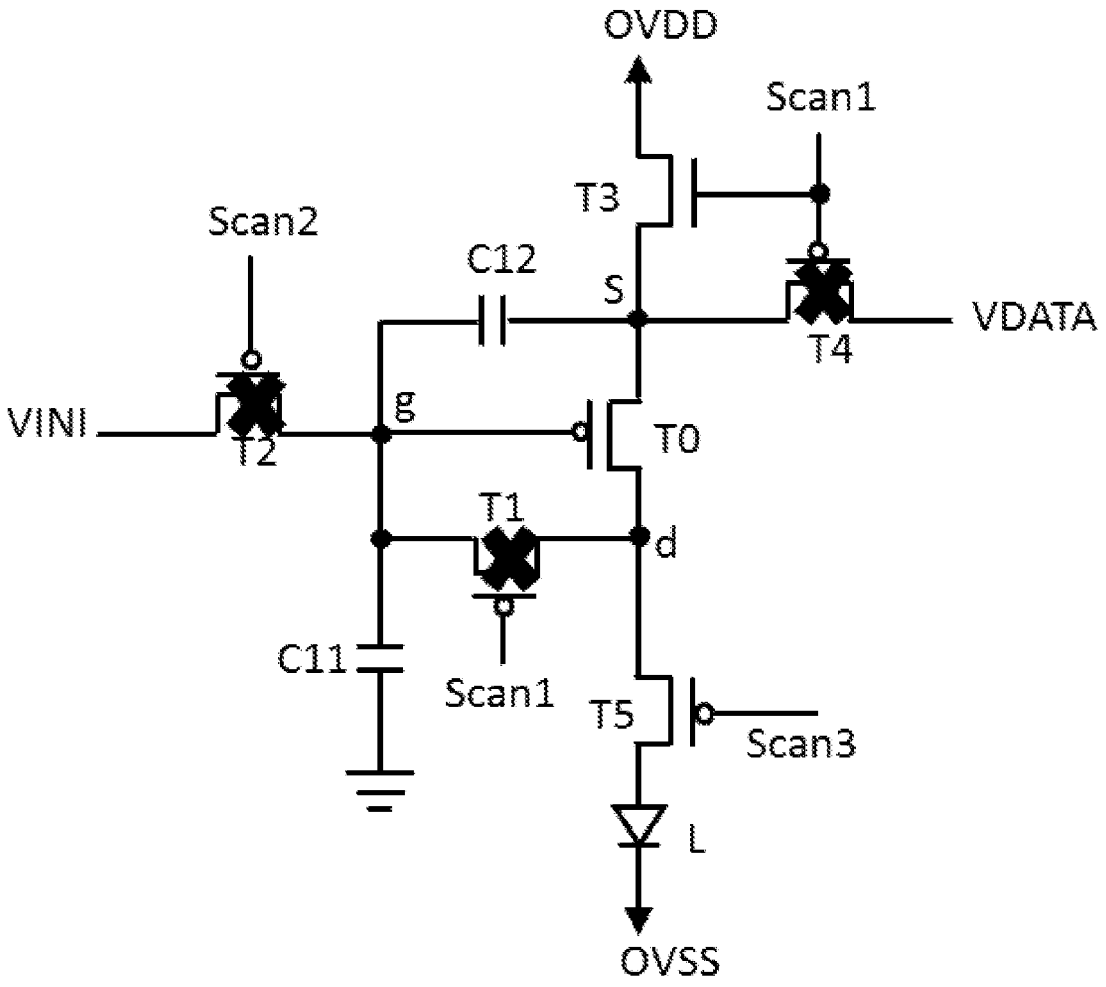
FIG. 8 is a state diagram of a lighting phase of a pixel driving circuit according to an embodiment of the present application.

S104, refer to FIG. 4, FIG. 5 and FIG. 8, when entering the lighting phase t3, the source terminal s is loaded with the driving voltage Vdd, so that the potential of the gate terminal g is changed, so that the driving current I of the driving transistor T0 is stable.

Further, the pixel driving circuit further comprises a negative voltage-signal terminal OVSS, and the light-emitting diode L comprises a positive terminal and a negative terminal. The fifth switch T5 is connected between the drain terminal d and the positive terminal. The negative terminal is connected with the negative voltage-signal terminal OVSS.

In one embodiment, the first control-signal terminal Scan1 and the second control-signal terminal Scan2 are loaded with a high-level signal, and the third control-signal terminal Scan3 is loaded with a low-level signal so that the third switch T3 and the fifth switch T5 are turned on; the second switch T2, the first switch T1 and the fourth switch T4 are turned off. The third switch T3, the driving transistor T0, and the fifth switch T5 are turned on, so that the driving-voltage-signal terminal OVDD and the negative voltage-signal terminal OVSS are conducted to drive the light-emitting diode L to light. The source terminal s is loaded with the driving voltage Vdd via the third switch T3. According to the charge sharing principle, the potential at the gate terminal g is Vdata−Vth+δV, the potential difference between the potential at the source terminal s and the potential at the gate terminal g is Vdd−Vdata+Vth−δV, and δV=(Vdd−Vdata)*C2/(C1+C2), C1 is a capacitance of the first capacitor C11, and C2 is a capacitance of the second capacitor C12. According to a transistor I-V curve equation $I=k(Vsg-Vth)^2$, where Vsg is a potential difference between a potential of the source terminal s and a potential of the gate terminal g, $I=k[(Vdd-Vdata)*C1/(C1+C2)]^2$, k is the intrinsic conduction factor of the driving transistor T0, which is determined by the characteristics of the driving transistor T0 itself. It can be seen that the driving current I is independent of the threshold voltage Vth of the driving transistor T0, and the driving current I is the current flowing through the light-emitting diode L. Therefore, the pixel driving circuit driven by the pixel driving method provided in this embodiment of the present application eliminates the influence of the threshold voltage Vth on the light-emitting diode L, improves the display uniformity of the panel, and improves the luminous efficiency.

The foregoing disclosure is merely one preferred embodiment of the present application, and certainly cannot be used to limit the scope of the present application. A person having ordinary skill in the art may understand that all or part of the processes in the foregoing embodiments may be implemented, and the present application may be implemented according to the present application, equivalent changes in the requirements are still covered by the application.

What is claimed is:

1. A pixel driving circuit, comprising a driving transistor, a first switch, a second switch, a third switch, a fourth switch, a first capacitor, a second capacitor, an initial-voltage-signal terminal, a data-voltage-signal terminal, a driving-voltage-signal terminal, and a first control-signal terminal;

wherein the driving transistor comprises a gate terminal, a source terminal, and a drain terminal;

the first switch is connected between the gate terminal and the drain terminal; the second switch connects the gate terminal with the initial-voltage-signal terminal; the third switch connects the source terminal with the driving-voltage-signal terminal, and the fourth switch connects the source terminal with the data-voltage-signal terminal, wherein the third switch and the fourth switch that connect the source terminal with the driving-voltage-signal terminal and the data-voltage-signal terminal, respectively, are controlled by a common control signal to operate opposite to each other so as to alternately switch on to connect the source terminal to the driving-voltage-signal terminal and the data-voltage-signal terminal in an alternate manner;

the first capacitor is connected between the gate terminal and a ground terminal, and the second capacitor is connected between the gate terminal and the source terminal; and the first control-signal terminal is connected with a control terminal of the first switch, a control terminal of the third switch, and a control terminal of the fourth switch, the first control-signal terminal supplies the common signal, so as to control on/off of the first switch, the third switch and the fourth switch.

2. The pixel driving circuit according to claim 1, further comprising a second control-signal terminal, wherein the second control-signal terminal is connected with a control terminal of the second switch, so as to control on/off of the second switch.

3. The pixel driving circuit according to claim 2, further comprising a fifth switch, a light-emitting diode and a negative voltage-signal terminal, wherein the light-emitting diode comprises a positive terminal and a negative terminal, the fifth switch is connected between the drain terminal and the positive terminal, so as to control on/off of the driving transistor and the light-emitting diode, the negative terminal is connected with the negative voltage-signal terminal.

4. The pixel driving circuit according to claim 3, further comprising a third control-signal terminal, wherein the third control-signal terminal is connected with a control terminal of the fifth switch, so as to control on/off of the fifth switch.

5. A display panel, comprising a pixel driving circuit, which comprises a driving transistor, a first switch, a second switch, a third switch, a fourth switch, a first capacitor, a second capacitor, an initial-voltage-signal terminal, a data-voltage-signal terminal, and a driving-voltage-signal terminal, the driving transistor comprises a gate terminal, a source terminal, a drain terminal, and a first control-signal terminal;

wherein the first switch is connected between the gate terminal and the drain terminal, the second switch connects the gate terminal with the initial-voltage-signal terminal; the third switch connects the source terminal with the driving-voltage-signal terminal and the fourth switch connects the source terminal with the data-voltage-signal terminal, wherein the third switch and the fourth switch that connect the source terminal with the driving-voltage-signal terminal and the data-voltage-signal terminal, respectively, are controlled by a common control signal to operate opposite to each other so as to alternately switch on to connect the source terminal to the driving-voltage-signal terminal and the data-voltage-signal terminal in an alternate manner;

the first capacitor is connected between the gate terminal and a ground terminal, the second capacitor is connected between the gate terminal and the source terminal; and the first control-signal terminal is connected with a control terminal of the first switch, a control terminal of the third switch, and a control terminal of the fourth switch, the first control-signal terminal supplies the common signal, so as to control on/off of the first switch, the third switch and the fourth switch.

6. The display panel according to claim 5, further comprising a second control-signal terminal, wherein the second control-signal terminal is connected with a control terminal of the second switch, so as to control on/off of the second switch.

7. The display panel according to claim 6, further comprising a fifth switch, a light-emitting diode and a negative voltage-signal terminal, wherein the light-emitting diode comprises a positive terminal and a negative terminal, the fifth switch is connected between the drain terminal and the positive terminal, so as to control on/off of the driving transistor and the light-emitting diode, the negative terminal is connected with the negative voltage-signal terminal.

8. The display panel according to claim 7, further comprising a third control-signal terminal, wherein the third control-signal terminal is connected with a control terminal of the fifth switch, so as to control on/off of the fifth switch.

* * * * *